United States Patent [19]

Boulanger

[11] Patent Number: 4,681,386

[45] Date of Patent: Jul. 21, 1987

[54] INTEGRAL CONNECTOR HAVING PLASTIC SPRING-CLIPS

[75] Inventor: Edward Boulanger, Hamden, Conn.

[73] Assignee: Lance Wire and Cable, Inc.

[21] Appl. No.: 820,741

[22] Filed: Jan. 22, 1986

[51] Int. Cl.[4] ..... H01R 13/627

[52] U.S. Cl. ..... 439/347; 439/557

[58] Field of Search ..... 339/91 R, 143 R, 128

[56] References Cited

U.S. PATENT DOCUMENTS

| | | | |
|---|---|---|---|
| 3,543,219 | 11/1970 | Pautrie | 339/128 |
| 4,460,230 | 7/1984 | McKee et al. | 339/91 R |
| 4,497,533 | 2/1985 | Genova et al. | 339/143 R |
| 4,556,270 | 12/1985 | Schutzle et al. | 339/91 R |
| 4,634,203 | 1/1987 | Noyes | 339/92 M |

FOREIGN PATENT DOCUMENTS

| | | | |
|---|---|---|---|
| 1196099 | 6/1970 | United Kingdom | 339/91 R |

*Primary Examiner*—John McQuade
*Attorney, Agent, or Firm*—John J. Byrne

[57] ABSTRACT

A novel electrical connector structure having integrally molded plastic construction with a first premold core and a second integrally molded external shell separated by metallic foil or stamping. Plastic spring-clips of integral plastic formation are also provided with dual notches thereon one for direct engagement with a matching connector and the other a mounting panel or bracket. Concurrent connection of the connector to a matching connector and to a panel or bracket is made possible in which the matching connector is independently attachable or detachable from the connector with respect to said panel or bracket. The spring-clips are of such a compressible configuration such that when compressed the spring-clip deforms or deflects from its original configuration, and upon release of external pressure, it tends to revert back to its original disposition. The matching connector is also of integrally molded plastic construction and has plastic spring-clips with a compressible configuration for latching onto said connector structure.

4 Claims, 11 Drawing Figures

INTEGRAL CONNECTOR HAVING PLASTIC SPRING-CLIPS

FIELD AND BACKGROUND OF INVENTION

This invention relates to electrical connectors for coupling electrical wires/cables to other electrical wires/cables or other electrical components for purposes of data/signal transmission and communication.

Connectors having the above mentioned functions have been known in the past. These connectors in the prior art ordinarily employ a connector housing comprising a plurality of divisible components fastened or bound together via some type of fastening mechanism. They share in certain common disadvantages associated with such a design. Namely, the electrical contacts within the housing are prone to dislocation upon pressure, generally known as "pushing back of the contacts", and non-contiguous shielding from the cable shield to the connector shell. Furthermore, these connectors may be disembodied or disassembled if their fastening mechanisms can not withstand the stress of physical impact or other kinds of misuse. Other kinds of connectors in the prior art do have an integrally constructed connector housing; however, they include non-plastic or metallic locking posts, clips, or other fastening means such as screws, bolts . . . etc. for latching onto a matching connector. Metallic fasteners as such are not flexibly adaptive and tend to slip and slide on their contacting surfaces. As a result, prior art connectors tended to provide a week coupling to matching connectors. Metallic fasteners oftentimes do not meet a high standard of pulltest requirement measured in pounds of pressure. A common field standard requires 35 pounds of pull-test pressure.

Another deficiency in connectors of the past pertains to their adaptability to be mountable on an equipment panel or bracket. Prior art connectors are not readily adaptable to serve in this capacity; normally, they include mechanical fasteners which require substantial human manipulation in order to attach or detach. A common means is by way of screws and bolts. In this manner, connectors are not quickly mountable onto a bracket or a panel and are similarly plagued in its detachment therefrom. This problem is equally disadvantages when matching connectors are directly coupled via such fastener, means. It is difficult for an operator to work with screws and bolts and it is often the case that special tools as required are not always available when an operator needs them. As a result, prior art connectors are inflexible, less adaptive, and clumsy upon installation and disconnection.

The problems suggested in the preceeding are not intended to be exhaustive, but rather are among many which may tend to reduce the effectiveness and appeal of prior art electrical connectors. Other noteworthy problems may exist; however, those presented above should be sufficient to demonstrate that connectors in the past have not been altogether satisfactory and a new design for electrical connectors is needed, that would represent an improvement over the prior art.

OBJECTIVES OF INVENTION

It is a primary object of the instant invention to provide an electrical connector of sturdy construction for withstanding impact and abuse.

It is a primary object of the instant invention to provide an electrical connector capable of providing enhanced and reliable coupling to a matching connector.

It is a primary object of the instant invention to provide an electrical connector with simple and convenient means of attachment and detachment to a matching connector.

It is a primary object of the instant invention to provide an electrical connector with simple and convenient means of attachment and detachment to a panel or a bracket.

It is a primary object of the instant invention to provide a single electrical connector structure capable of securely connecting singularly to a matching connector, while freely disposed, singularly to a mounting panel or bracket for fixation with respect thereto, or simultaneously to said panel or bracket and to said matching connector, in a fixed disposition.

It is an object of the instant invention to provide an electrical connector which minimizes any dislocation of electrical contacts therein.

It is another objective of the instant invention to provide an electrical connector which yields contiguous shielding from cable shield to connector shell.

It is another objective of the instant invention to allow a flex relief to be molded as part of the connector housing.

It is another objective of the instant invention to effect any one or more of the foregoing objectives.

SUMMARY OF THE INVENTION

A novel electrical connector structure of integrally molded construction and including plastic adaptive spring-clips for providing enhanced structural integrity and strength of connection to a matching connector. The novel connector structure is capable of securely attaching singularly to a matching connector, while freely disposed, to a mounting panel or bracket for fixation relative thereto, or simultaneously to said panel or said bracket, and to said matching connector, in a fixed disposition. The matching connector is equally of novel construction for it is also integrally molded and includes plastic spring-clips (in opposing orientation relative to those on said novel electrical connector) for enhanced durability and improved strength of connection.

DETAILED DESCRIPTION

Figure 8A:
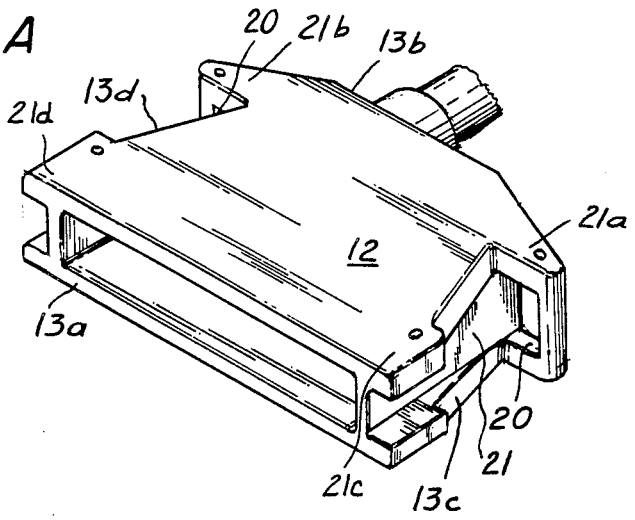
FIG. 8A is a perspective view of the connector housing.

In reference to the drawings wherein like numerals indicate like parts, the numeral 10 indicates an electrical connector. A housing 12 of this connector is integrally molded in construction. In the instant case, it is doubly molded in the sense that a premold is first formed and then subsequently wrapped in an externally molded shell. A metallic foil (not shown) or stamping is imposed therebetween for shielding action. Wire leads are fixedly secured within said plastic integral premold. The housing 12 is not a collection of separate parts fastened together for intended subsequent disassembly and reformation but is a molded unit. A flex relief 14 is molded as part of the external shell for providing a means for relieving strain on the connecting cable 16. As seen in FIG. 8A, the housing 12 is defined by a front 13*a*, a rear 13*b*, and sides 13*c* and 13*d*. Extending outwardly from sides 13*c* and 13*d*, respectively, are rear flanges 21*a* and 21*b*. Forward flanges 21*c* and 21*d* extend respectively from side walls 13*c* and 13*d* at front side 13*a*. The other housing 40 is similarly formed. Spring-clips or locking arms 18 have respective end portions 23 received in bores 20 on opposing sides of the housing 12 in flanges 21*a* and 21*b*, and are also pivotally mounted to the housing via pins 19, the ends of which are coupled to the opposing sides of the housing at flanges 21*a* and 21*b*. The pins 19 extend through the spring-clips via openings 25 on end portions 23 thereof. The connector housing and spring-clips are formed of plastic in the disclosed embodiments, and the spring-clips are also integral in structure. The connector housing and spring-clips may be made of vinyl, polypropelene, or any other suitable plastic material.

The locking arms or spring-clips 18, as naturally configured, assume corresponding positions in parallel on opposing sides 13*c* and 13*d* of the housing 12 and in the general direction as indicated by arrow A pointing toward an object to be connected to the connector 10.

The tip 22 of each spring-clip, makes actual contact with an object to be connected thereto. Tips 22 of the spring-clips respectively includes a slanting surface 24 in a direction convergent toward each other in the general direction of arrow A. Additionally, each tip 22 includes a notched indenting space or recess 26 (see FIG. 7A) formed by railings 28. Notch or recess 26 is designed to receive in an interlocking relationship a corresponding hooked structure or tip 50 on a connecting object, as it slides past the slanting surface 24. Tip 22 also includes a second notched area 30 forming shoulder 31 for engaging in an interlocking manner an edge of a mounting panel or a bracket; this second notched area is partially defined by lateral edges 32 of the railings 28.

End portions 23 (not entirely visible in FIG. 1) at the rear of spring-clips 18 are received in openings 20. End portions 23 have holes 25 extending therethrough. The spring-clips 18 are pivotally connected to the housing 12 via pin 19 the ends of which are connected to opposing sides of the housing 12, and which extend through holes 25 in flanges 21*a* and 21*b*. The arm portion 34 including tip 22 is deflectable in either direction B or C when subjected to externally imposed pressure, because of the intrinsic flexibility in plastic material. When moving in direction B responsive to external pressure, spring-clip 18 together with tip 22 intrude into indenting grooves 21 along lateral edges of the connector housing 12. A knurled external surface area 36 is provided on arm portion 34 for facilitating user manipulation of the spring-clip in pressing the tip 22 inwardly in direction B to engage or disengage the connector 10 from a matching connector or from a panel or bracket. Pivotal action of the arm 34 including tip 22 in direction B is restricted due to structural abutments of portions of the spring-clip (not visible in FIG. 1) against the housing 12. The movements of the spring-clip in directions B and C, responsive to external pressure are primarily derived through the intrinsic flexibility of plastic material. In the absence of externally applied pressure, the spring-clips will naturally revert back to their position as originally configured.

Figure 1:
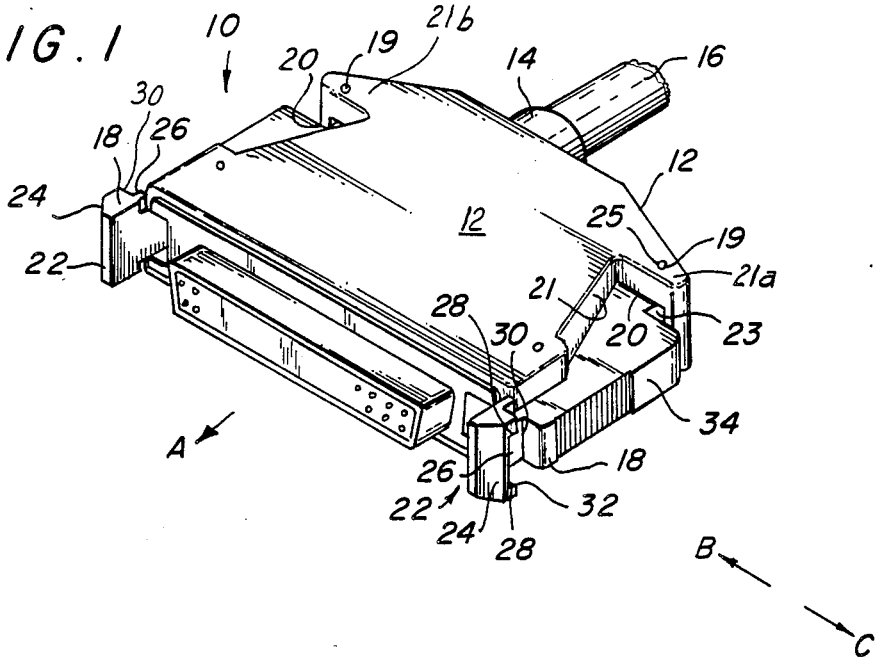
FIG. 1 is a top perspective view of the electrical connector in accordance to the instant invention.
Figure 2:
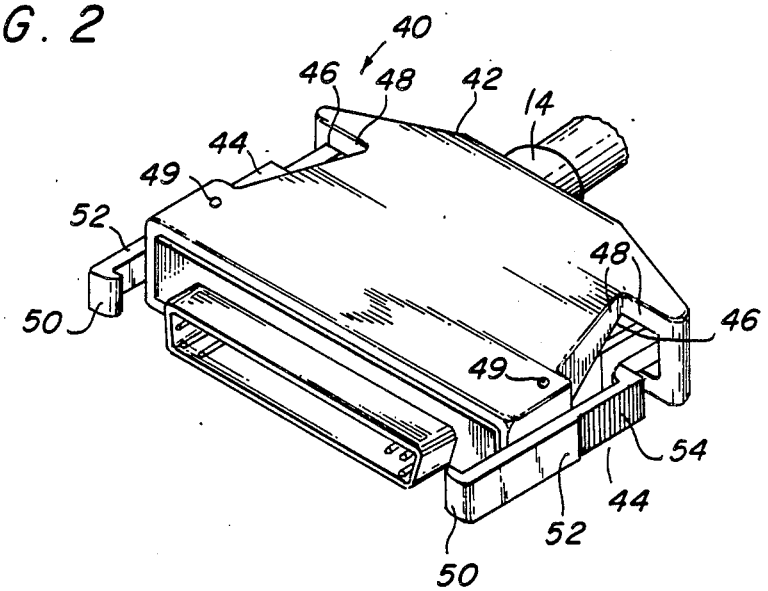
FIG. 2 is a top perspective view of a matching connector in accordance to the instant invention.

In FIG. 2, there is shown a matching connector 40 for connection to connector 10. Connector 40 is also of integral construction, and in the disclosed embodiment it is also doubly molded with an inner plastic premold and an external molded shell separated by a thin metallic foil or stamping located therebetween for shielding. Housing housing 42 and its associated spring-clips 44, all of which are formed from plastic. Each spring-clip 44 has a curved end portion 45 and a spring extension 51 (see FIG. 7B) received in indenting grooves 46 extending directly beneath edge areas 48. Lateral surface areas of the housing 42 define grooves 46. Each spring-clip 44 is pivotally mounted around pin 49 for pivotal action with respect thereto. The spring-clips 44 are mounted on opposing sides of the housing in parallel as in the case of the connector 10 of FIG. 1.

Spring-clips 44 include a hooked tip structure 50 for latching in corresponding recesses 26 on the connector 10 of FIG. 1, and an arm portion 52 with knurled surface area 54 for facilitating user manipulation in causing the hooked tips 50 to pivot away from each other in order to come into an inter-locking engagement with a corresponding connecting structure such as the spring-clip 18 of connector 10 of FIG. 1 or mounting panels 60 or brackets, or to break lose from such structure. Upon such pivotal action, the curved end portions 45 and extension 51 are thrusted further into grooves 46 and also compressed against lateral edges of the housing 42. Such compression is provided via inherent flexibility of plastic material, and permits the structure to revert back to its original position upon release of external pressure.

Figure 3:
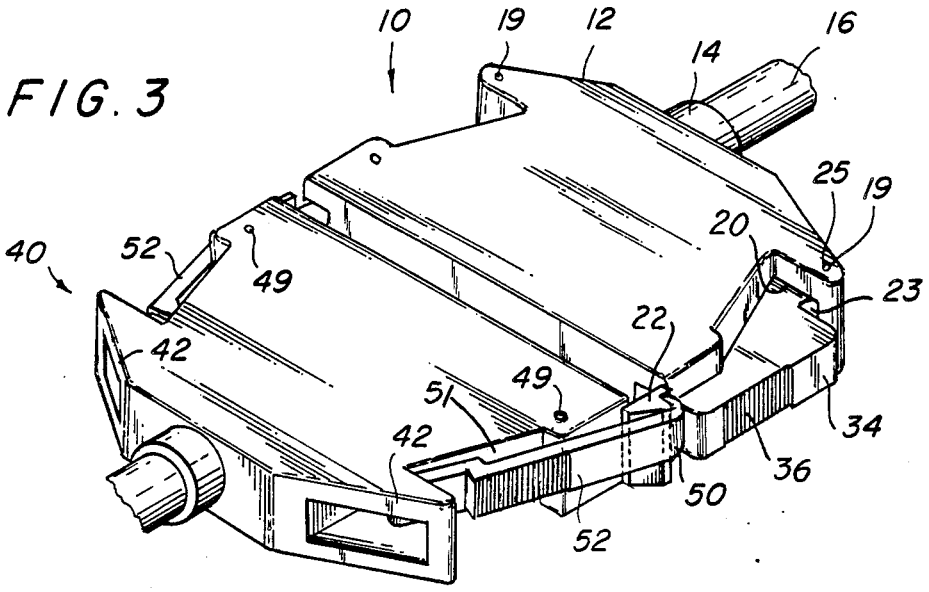
FIG. 3 is a top perspective view of the connectors of FIGS. 1 and 2 coupled together.

In FIG. 3, the connector 10 of FIG. 1 is shown connected to the matching connector 40 of FIG. 2. The hooked tip structure 50 of the matching connector has slid pass slanting surface 24 and is engaged with recess 26 in an inter-locking manner. The flexible and adaptive characteristics of plastic material enable the engagement to remain secure despite minor movements of the spring-clips in various direction. Such a connection easily satisfies a 35 pound pulltest field standard for such connectors. As shown in FIG. 3, both connectors are freely disposed in that they are not fixedly mounted to any panel or bracket. The spring-clips enable easy connection and disconnection by users without requiring tools of any kind.

Figure 4:
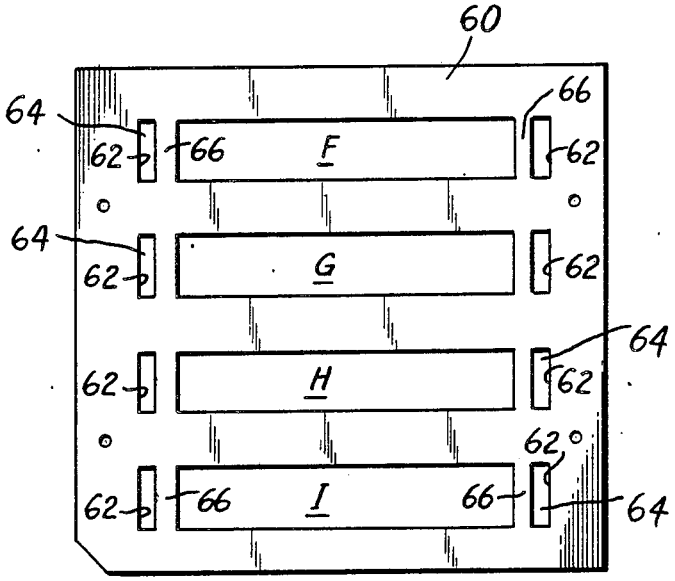
FIG. 4 is a front elevation view of a mounting panel or bracket to which a novel electrical connector of the instant invention may be fixedly secured.
Figure 5:
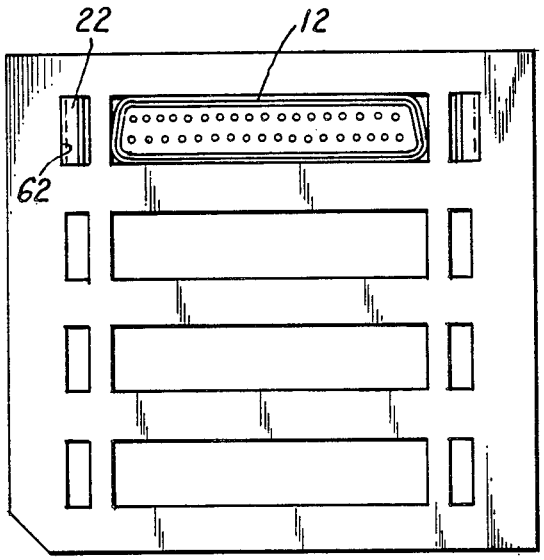
FIG. 5 illustrates a front elevation view of the panel or bracket of FIG. 4 in combination with a novel electrical connector fixedly mounted thereto.
Figure 9:
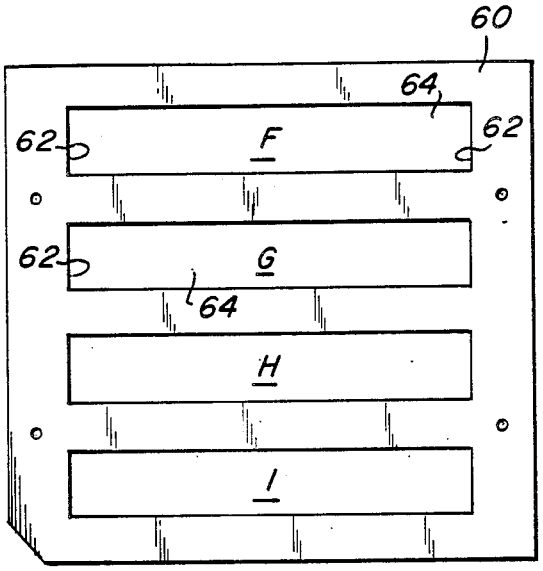
FIG. 9 is a front elevation view of another mounting panel or bracket to which the novel electrical connector of the instant invention may be fixedly coupled.

In FIG. 4, the mounting panel/bracket 60 is shown. It resembles a structural support component within electrical systems for mounting of electrical connectors thereto. Slots F, G, H, and I designate areas in whih connectors may be mounted. In FIG. 5, the connector 10 of FIG. 1 is mounted on bracket 60. Here notched area or shoulder area 30 of tip 22 on spring-clip 18 engages with inside edges 62 of the bracket. Each edge 62, also shown in FIG. 4, partially define end openings 64 through the bracket. In the embodiment illustrated, end openings 64 are separate from slots F, G, H, and I; however, each slot is itself an opening through the bracket by edges 62 and constitute separate openings, in which case the divider areas 66 between each slot and a corresponding bore are not present; this construction of the panel or bracket is clearly shown in FIG. 9.

In operation each tip 22 is first depressed inwardly towards each other, inserted through the bore 64 and than allowed to revert back to its natural position in which position notch 30 is tightly engaged with edge 62 to form a fixed connection between the connector 10 and the bracket 60. FIGS. 3 and 5 collectively illustrate that the connector 10 is connectable to a fixed panel or bracket as well as to a matching connector in a freely disposed posture.

Figure 6:
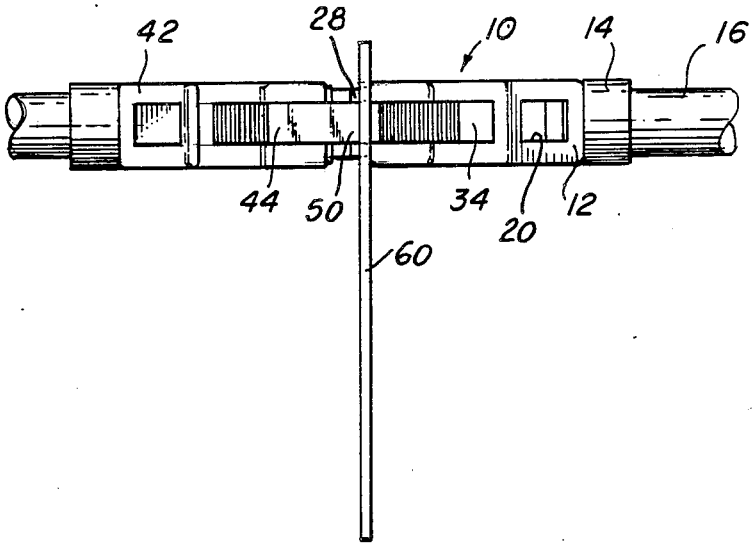
FIG. 6 is a side view of a novel electrical connector simultaneously coupled to a matching connector as in FIG. 3 above and also to said mounting panel or bracket as shown in FIG. 5 above, in a fixed disposition.

In FIG. 6, the connector 40 is additionally connected to the matching connector 10, while connector 10 remains connected to the bracket 60 shown in FIG. 5. The matching connector is engaged in an inter-locking relationship with the connector 10 in the manner illustrated in FIG. 3, while the bracket 60 is engaged in an interlocking relationship with the connector 10 in the manner shown in FIG. 5. Such simultaneous coupling is made possible by the separate notches 26 and 30 on each tip 22 of the spring-clips 18 of the connector 10. Notch 26 is used for engagement with the hooked structure 50 of the spring-clip 44 of the matching connector 40, while notch 30 is used for engagement with internal lateral edges of a mounting panel or bracket. The concurrent connections do not interfere with each other to the extent that the matching connector may be attached and removed from the connector 10 while connector 10 remains fixedly coupled to the bracket 60. Consequently, FIGS. 3, 5, and 6 collectively illustrate that connector 10 is connectable to a matching connector via plastic spring-clips, either when connector 10 is freely disposed or when it is mounted to a panel or bracket via the same set of plastic spring clips.

Figure 7A:
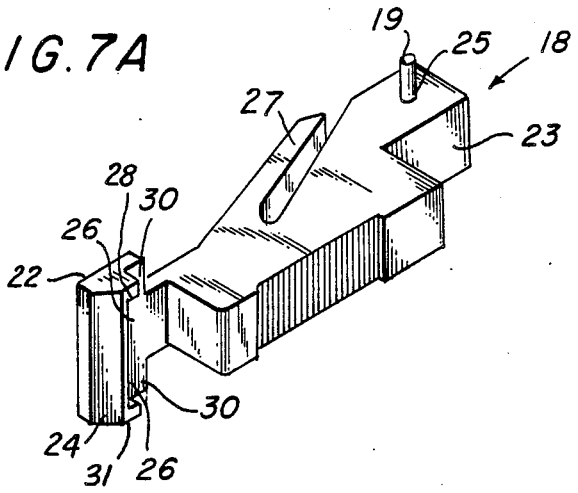
FIG. 7A is a perspective view of a spring-clip of the novel electrical connector of FIG. 1, removed from the electrical connector.
Figure 7B:
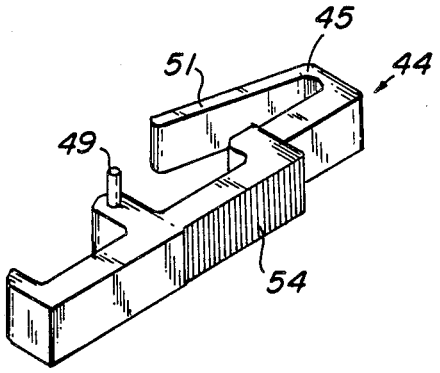
FIG. 7B is a side view of a spring-clip of the matching connector of FIG. 2, removed from the matching connector.

In FIG. 7A, the spring-clip 18 of connector 10 is shown in a separate posture removed from the connector housing 12. Notches 26 and 30 as shown are clearly separate and are independently functional for engagement respectively to a matching connector and to a mounting panel or bracket. Hole 25 is shown through which a mounting pin 19 extends as shown in FIG. 1. End portion 23 and structure 27 are for immediate abutment with the housing 12 within bore 20 of FIG. 1, and tend to restrict pivotal action about pin 19, thereby emphasizing the flexing role of plastic spring-clips upon deflection into bore 20. In FIG. 7B, spring-clip 44 of matching connector 40 is shown in a posture removed from the housing 42. In this illustration, the curved end portion 45 is clearly shown. Spring extensions 51 on curved end portion 45 is initially in contact with an internal lateral surface of the housing 42 within indenting bore 46 of FIG. 2. Upon application of external force on knarled area 54 toward area 51, the spring-clip 44 pivots about pin 49 of FIG. 2 and the curved end portion 45 and the spring extensions 51 are compressed against the housing 42. Upon release of external pressure, the original curvature of curved end portion 45 is reformed due to the intrinsic flexibility of plastic material and the spring-clip 44 reverts back to its originally configured position of FIG. 2 due to the elastic flexibility of plastic material.

Figure 8B:
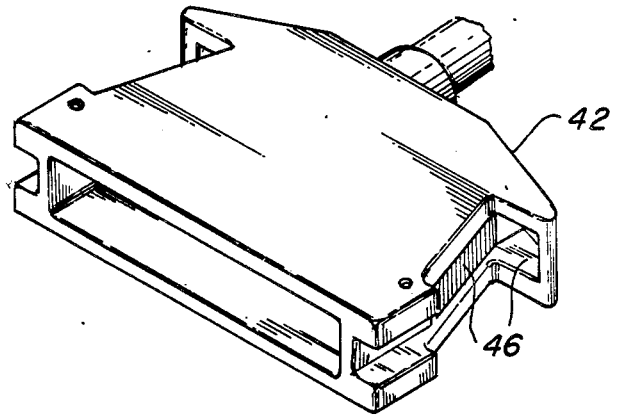
FIG. 8B is a perspective view of the housing of FIG. 2.

In FIG. 8A, the housing 12 of connector 10 is illustrated without spring-clips 18 attached thereto. The configuration of opening 20 can be clearly seen. In FIG. 8B, the housing 42 of matching connector 40 is illustrated without spring-clips 44 attached thereto. The configuration of opening 46 can be clearly seen as the same as openings 20.

In describing the subject invention, reference has been made to preferred embodiments. Those skilled in the art, however, and familiar with the disclosure of the subject invention, may recognize additions, deletions, substitutions, modifications, and/or other changes which will fall within the purview of the subject invention claimed below.

SUMMARY OF MAJOR ADVANTAGES

With the connector structures disclosed herein, attachment and detachment of a connector from another or from a panel or bracket are extensively facilitated; no special tools or instruments are required. Also, the structural integrity of the connector is greatly enhanced. Undesired movements of electrical contacts are eliminated, continuous electrical shielding, and integral flex relief are provided by way of intergrally molded connector housing construction, and plastic spring-clips eliminate the need for clumsy mechanical fastening mechanisms. Adaptive and flexible plastic spring-clips enable a stronger and more secure connection, as they are flexibly adaptive to changing postures of the connector. Furthermore, one piece, the integral spring-clips are simple in design and construction as well as less likely to fail as compared to larger and more complex mechanisms.

More importantly, a single connector structure is shown which may connect directly to a matching connector or to a mounting panel or bracket, as well as concurrently to said matching connector and to said panel or bracket. In case of concurrent connection, the matching connector may be independently attached or detached from said connector structure while said panel or bracket remains directly connected thereto. Of course, the advantages stated in the immediately preceding paragraph are also made available. In this manner, an effective and reliable connector is provided with greatly enhanced adaptability and expanded applications.

I claim:

1. An electrical connector for connection to a panel having an opening therethrough or to a second connector comprising, a plastic housing for reception of a multi-wired cable at the rear end thereof and a multi-contact plug at the front end thereof;

said housing having first and second side walls between said front end and said rear end;

a first pair of front flanges extending outwardly from said side walls adjacent said front end;

a second pair of rear flanges extending outwardly from said side walls adjacent said rear end, a first plastic spring clip along said first side wall and having a forward end extending forwardly of said housing and having a rear portion;

a second plastic spring clip along said second side wall and having a forward end extending forwardly of said housing and having a rear portion;

said rear flanges having first and second openings respectively receiving said rear portions of said spring clips;

means pivotally supporting said spring clips on said rear flanges;

means integral with said spring clips for biasing said forward ends away from one another; and first and second shoulders respectively formed on the forward ends of said spring clips and extending outwardly therefrom, said first and second shoulders formed with outwardly tapering surfaces and with recesses rearwardly of said tapered surfaces.

2. An electrical connection comprised of first and second housings of a type that can be joined together independently or through a panel having an opening therethrough wherein each of said housings comprises;

a front end, a rear end, first and second side walls extending between said front and rear ends, a pair of rear flanges one each of which extends outwardly from its respective side wall, and a pair of forward flanges one each of which extends outwardly from its respective side wall;

a first pair of spring clips;

first pivot means mounting said first pair of spring clips on said rear flanges of said first housing;

a second pair of spring clips;

second pivot means mounting said second pair of spring clips to said forward flanges of said second housing; and inter-engagement means on said first pair of spring clips and on said second pair of spring clips for securing said first pair of spring clips to said second pair of spring clips.

3. The invention of claim 2 wherein said interengagement means include, first and second shoulders respectively formed on forward ends of said first pair of spring clips and extending outwardly therefrom for engagement with the sides of said opening.

4. The invention of claim 3 wherein said first and second shoulders are formed with recesses; and inwardly directed tips formed on said second pair of spring clips for location within said recesses.

* * * * *